US005290422A

United States Patent [19]

Michelsen-Mohammadein

[11] Patent Number: 5,290,422

[45] Date of Patent: Mar. 1, 1994

[54] PROCESS FOR APPLYING SILVER-GRAPHITE DISPERSION ELECTRODEPOSITS

[75] Inventor: Ursula Michelsen-Mohammadein, Berlin, Fed. Rep. of Germany

[73] Assignee: Siemens Aktiengesellschaft, Munich, Fed. Rep. of Germany

[21] Appl. No.: 927,476

[22] PCT Filed: Mar. 18, 1991

[86] PCT No.: PCT/DE91/00241

§ 371 Date: Sep. 28, 1992

§ 102(e) Date: Sep. 28, 1992

[87] PCT Pub. No.: WO91/14808

PCT Pub. Date: Oct. 3, 1991

[30] Foreign Application Priority Data

Mar. 28, 1990 [DE] Fed. Rep. of Germany ..... 4010346

[51] Int. Cl.[5] ..... C25D 15/00

[52] U.S. Cl. ..... 205/109

[58] Field of Search ..... 305/109

[56] References Cited

FOREIGN PATENT DOCUMENTS 2086940 5/1982 United Kingdom .

*Primary Examiner*—T. M. Tufariello

*Attorney, Agent, or Firm*—Kenyon & Kenyon

[57] ABSTRACT

A process for applying silver-graphite dispersion electrodeposits from an electrolyte with a conducting salt that is free of free cyanide. The process facilitates working at relatively high current densities to achieve high speed plating.

17 Claims, No Drawings

PROCESS FOR APPLYING SILVER-GRAPHITE DISPERSION ELECTRODEPOSITS

The invention relates to a process for applying silver-graphite dispersion electrodeposits using an electrolyte containing alkali-metal silver cyanide, a conducting salt, graphite, a wetting agent, and a brightener.

BACKGROUND OF THE INVENTION

DE 25 43 082 C3 discloses a process of this type. In this known process for applying dispersion electrodeposits, potassium cyanide as a free cyanide is used as a supporting electrolyte. Suited as wetting agents for the known process are, inter alia, Turkey-red oil, sulphonated oleate ester, and fatty alcohol sulphonate. The known process is used to galvanize metal objects such as frames at current densities from to 1 to 5 A/dm$^2$.

SUMMARY OF THE INVENTION

The object of the invention is to propose a process for applying silver-graphite dispersion electrodeposits with an electrolyte that is free of free cyanide and facilitates working at relatively high current densities to achieve high speed plating.

To solve this task using a process of the type indicated at the outset, according to the invention, the silver-graphite dispersion electrodeposits are applied with an electrolyte that has a conducting salt that is free of cyanide.

An advantage of the process according to the invention is that the process is carried out with an electrolyte free of free cyanide. Another advantage is that higher current densities can be attained when galvanizing the metal objects. A further advantage is that one works with insoluble anodes.

In the process according to the invention, the silver-graphite dispersion electrodeposits are advantageously applied using a flow or spray galvanizing method in conveyorized equipment. The flow or spray galvanization makes it possible to partially coat the parts that receive the electrodeposits. Moreover, the process according to the invention can be carried out at relatively high current densities, which results in fast deposition.

DETAILED DESCRIPTION

Various salts may be used as a conducting salt without free cyanide. It is considered particularly advantageous to apply di-potassium hydrogen phosphate, potassium diphosphate r n alkali-metal salt of organic acids as a conducting salt; these alkali-metal salts can be potassium citrate, potassium malate or sodium acetate.

To attain silver-graphite electrodeposits having 1 to 2.5% graphite content at amperages of up to 20 A/dm$^2$, in the process according to the invention, anion-active wetting agents are used as wetting agents at a concentration of 0.5 to 30 ml/1.

For such wetting agents, one can utilize alkali metal salts of alkyl sulphates or alkyl sulphonates having a straight-chain or branched alkyl chain length of C4 to C14, or an alkali-metal salt of a highly sulphatized fatty acid. A straight-chain alkyl sulphate of an alkali metal salt has, for example, the following structure:

$$CH_3-(CH_2)_n-O-SO_3-Na^+ \text{ or } K^+$$

n=3 to 9

A branched alkyl sulphate of an alkali-metal salt has, for example the following structure:

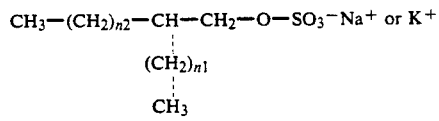

n1=0 to 3
n2=0 to 7

The following structure is indicated as an example for alkyl sulphonates of an alkali-metal salt:

$$CH_3-(CH_2)_n-SO_3-Na^{30}$$

n=4 to 13

Protein fatty acid condensates and protein hydrolyzates are capable of being applied as wetting agents according to the process of the invention.

The following examples are given to clarify the invention.

EXAMPLE 1

After a customary electroplating pretreatment, metal objects, which are to receive a silver-graphite dispersion electrodeposit, are coated with an electrolyte having the following composition:

| | | |
|---|---|---|
| potassium silver cyanide | K [AG (CN)$_2$] | 120 g/l |
| di-potassium hydrogen phosphate | $K_2HPO_4$ | 90 g/l |
| graphite | C | 100 g/l |
| potassium selenocyanate | KSeCN | 10 mg/l |
| sodium 2-ethylhexylsulphate (40% active substance) | | 2 ml/l |
| pH-value | | 8.5 |
| temperature | | 30° C. |
| current density | | 5 A/dm$^2$ 10 A/dm$_2$ |
| graphite content of the electrodeposit 1.8% by weight-1.4% by weight | | |

EXAMPLE 2

After the customary pretreatment, metal objects are provided with dispersion electrodeposits in an electrolyte of the following composition under the indicated conditions:

| | | |
|---|---|---|
| potassium silver cyanide | K [AG (CN)$_2$] | 120 g/l |
| potassium diphosphate | $K_4P_2O_7$ | 80 g/l |
| graphite | C | 100 g/l |
| potassium selenocyanate | KSeCN | 10 mg/l |
| sodium alkyl sulphonate (40% active substance) | | 5 ml/l |
| pH-value | | 9.0 |
| temperature | | 20° C. |
| current density | | 5 A/dm$^2$ |
| graphite content in the electrodeposit | | 1.3% by weight |

EXAMPLE 3

After the customary pretreatment, silver-graphite dispersion electrodeposits are applied to metal objects with an electrolyte of the following composition under the conditions indicated in the following:

| | | |
|---|---|---|
| potassium silver cyanide | K [AG (CN)$_2$] | 120 g/l |
| tri-potassium citrate monohydrate | $C_6H_5K_3O_7.H_2O$ | 100 g/l |
| boric acid | $H_3BO_3$ | 30 g/l |
| graphite | C | 100 g/l |
| selenic acid | $H_2SeO_3$ | 2 g/l |
| sodium n-octylsulphate (42% active substance) | | 5 ml/l |
| pH-value | | 8 |
| temperature | | 30° C. |
| current density | | 5 A/dm$^2$ |
| graphite content in the electrodeposit | | 1.5% by weight |

I claim:

1. A process for applying silver-graphite dispersion electrodeposits using an electrolyte containing alkali-metal silver cyanide, a conducting salt, graphite, a wetting agent, and a brightener, wherein the silver-graphite dispersion electrodeposits are applied using an electrolyte with a conducting salt that is free of free cyanide.

2. The process according to claim 1, wherein the silver-graphite dispersion electrodeposits are applied using a flow or spray galvanizing method in conveyorized equipment.

3. The process according to claim 1, wherein di-potassium hydrogen phosphate is used as a conducting salt.

4. The process according to claim 1, wherein potassium diphosphate is used as a conducting salt.

5. The process according to claim 1, wherein an alkali-metal salt of organic acids is used as a conducting salt.

6. The process according to claim 1, wherein anion-active wetting agents are used as wetting agents at a concentration of 0.5 to 30 ml/1.

7. The process according to claim 6, wherein alkali-metal salts of alkyl sulphates or alkyl sulphonates having a straight-chain or branched alkyl chain length of C4 to C14 are used as the wetting agent.

8. The process according to claim 6, wherein an alkali-metal salt of a highly sulphatized fatty acid is used as the wetting agent.

9. The process according to claim 6, wherein a protein fatty acid condensate is used as the wetting agent.

10. The process according to claim 6, wherein a protein hydrolyzate is used as the wetting agent.

11. The process according to claim 2, characterized in that di-potassium hydrogen phosphate is used as a conducting salt.

12. The process according to claim 2, wherein potassium diphosphate is used as a conducting salt.

13. The process according to claim 2, wherein an alkali-metal salt of organic acids is used as a conducting salt.

14. The process according to claim 2, wherein anion-active wetting agents are used as wetting agents at a concentration of 0.5 to 30 ml/1.

15. The process according to claim 3, wherein anion-active wetting agents are used as wetting agents at a concentration of 0.5 to 30 ml/1.

16. The process according to claim 4, wherein anion-active wetting agents are used as wetting agents at a concentration of 0.5 to 30 ml/1.

17. The process according to claim 5, wherein anion-active wetting agents are used as wetting agents at a concentration of 0.5 to 30 ml/1.

* * * * *